US009886044B2

(12) United States Patent
Chen et al.

(10) Patent No.: US 9,886,044 B2
(45) Date of Patent: Feb. 6, 2018

(54) DYNAMIC CURRENT SINK FOR STABILIZING LOW DROPOUT LINEAR REGULATOR (LDO)

(71) Applicant: MediaTek Inc., Hsin-Chu (TW)

(72) Inventors: Chin-Hsun Chen, Taoyuan (TW); Hao-Yuan Lin, Taipei (TW); Chia-Hua Chou, Zhubei (TW)

(73) Assignee: MEDIATEK INC., Hsin-Chu (TW)

( * ) Notice: Subject to any disclaimer, the term of this patent is extended or adjusted under 35 U.S.C. 154(b) by 0 days.

(21) Appl. No.: 15/043,687

(22) Filed: Feb. 15, 2016

(65) Prior Publication Data

US 2017/0038783 A1 Feb. 9, 2017

Related U.S. Application Data

(60) Provisional application No. 62/202,636, filed on Aug. 7, 2015.

(51) Int. Cl.

| | |
|---|---|
| ***G05F 1/46*** | (2006.01) |
| ***G05F 1/563*** | (2006.01) |
| ***G05F 1/56*** | (2006.01) |

(52) U.S. Cl.

CPC ..... *G05F 1/46* (2013.01); *G05F 1/56* (2013.01); *G05F 1/563* (2013.01)

(58) Field of Classification Search

CPC . G05F 1/46; G05F 1/462; G05F 1/467; G05F 1/56; G05F 1/562; G05F 1/563; G05F 1/565; G05F 1/569; G05F 1/571; G05F 1/573; G05F 1/575; G05F 1/59

See application file for complete search history.

(56) References Cited

U.S. PATENT DOCUMENTS

| | | | | |
|---|---|---|---|---|
| 8,344,713 | B2 * | 1/2013 | Shrivas | G05F 1/575 323/273 |
| 8,773,096 | B2 * | 7/2014 | Wang | G05F 1/575 323/274 |
| 8,860,389 | B2 | 10/2014 | Gakhar et al. | |
| 9,600,006 | B2 * | 3/2017 | Kurozo | G05F 1/569 |
| 2003/0175017 | A1 | 9/2003 | Pelonis | |
| 2007/0030054 | A1 | 2/2007 | Lee et al. | |
| 2008/0180071 | A1 * | 7/2008 | Moraveji | H03K 5/08 323/268 |
| 2009/0167266 | A1 * | 7/2009 | Al-Shyoukh | G05F 1/569 323/276 |

(Continued)

*Primary Examiner* — Timothy J Dole
*Assistant Examiner* — David A. Singh
(74) *Attorney, Agent, or Firm* — Winston Hsu

(57) ABSTRACT

A dynamic current sink includes the following elements. A voltage comparator compares a reference voltage with a second control signal from an LDO (Low Dropout Linear Regulator) to generate a first control signal. A first transistor selectively pulls down a voltage at a first node according to the first control signal. The inverter is coupled between the first node and a second node. An NAND gate has a first input terminal coupled to a second transistor and a third node, a second input terminal coupled to the second node, and an output terminal coupled to a fourth node. A capacitor is coupled between the fourth node and a fifth node. A resistor is coupled between the fifth node and a ground voltage. A third transistor has a control terminal coupled to the fifth node, and selectively draws a discharge current from an output node of the LDO.

10 Claims, 13 Drawing Sheets

(56) References Cited

U.S. PATENT DOCUMENTS

| | | | | |
|---|---|---|---|---|
| 2009/0273237 | A1* | 11/2009 | Inoue | G05F 1/575 307/10.1 |
| 2009/0322295 | A1* | 12/2009 | Scoones | G05F 1/56 323/282 |
| 2010/0156362 | A1* | 6/2010 | Xie | G05F 1/565 323/273 |
| 2010/0156364 | A1* | 6/2010 | Cho | G05F 1/573 323/280 |
| 2010/0201331 | A1 | 8/2010 | Imura | |
| 2010/0213913 | A1 | 8/2010 | Shito | |
| 2012/0161734 | A1* | 6/2012 | Wu | G05F 1/575 323/282 |
| 2014/0117956 | A1 | 5/2014 | Price et al. | |

* cited by examiner

DYNAMIC CURRENT SINK FOR STABILIZING LOW DROPOUT LINEAR REGULATOR (LDO)

CROSS REFERENCE TO RELATED APPLICATIONS

This application claims the benefit of U.S. Provisional Application No. 62/202,636, filed on Aug. 7, 2015, the entirety of which is incorporated by reference herein.

BACKGROUND OF THE INVENTION

Field of the Invention

The disclosure generally relates to a dynamic current sink, and more specifically, to a dynamic current sink for stabilizing an output voltage of an LDO (Low Dropout Linear Regulator).

Description of the Related Art

An LDO (Low Dropout Linear Regulator) is a DC (Direct Current) linear voltage regulator which can regulate the output voltage even when the supply voltage is very close to the output voltage. The advantages of an LDO over other DC-to-DC regulators include the absence of switching noise, smaller device size, and greater design simplicity.

However, for practical application, if an external loading element driven by an output voltage of an LDO is changed, a loading current flowing through an output node of the LDO will be changed, and it will affect the output voltage of the LDO. For example, an overshoot output voltage or an undershoot output voltage may occur at the output node of the LDO, and such an output voltage fluctuation may degrade the stability of the LDO. Accordingly, there is a need to design a novel apparatus for overcoming the drawbacks of the conventional LDO.

BRIEF SUMMARY OF THE INVENTION

In a preferred embodiment, the invention is directed to a dynamic current sink for stabilizing an output voltage at an output node of an LDO (Low Dropout Linear Regulator). The dynamic current sink includes a first voltage comparator, a first transistor, a first current source, a first inverter, a second current source, an NAND gate, a first capacitor, a first resistor, a second transistor, and a third transistor. The first voltage comparator compares a first reference voltage with a second control signal from the LDO, so as to generate a first control signal. The first transistor has a control terminal for receiving the first control signal, a first terminal coupled to a ground voltage, and a second terminal coupled to a first node. The first current source supplies a first current to the first node. The first inverter has an input terminal coupled to the first node, and an output terminal coupled to a second node. The second current source supplies a second current to a third node. The NAND gate has a first input terminal coupled to the third node, a second input terminal coupled to the second node, and an output terminal coupled to a fourth node. The first capacitor is coupled between the fourth node and a fifth node. The first resistor is coupled between the fifth node and the ground voltage. The second transistor has a control terminal coupled to the fifth node, a first terminal coupled to the ground voltage, and a second terminal coupled to the third node. The third transistor has a control terminal coupled to the fifth node, a first terminal coupled to the ground voltage, and a second terminal coupled to the output node. The third transistor is configured to selectively draw a first discharge current from the output node.

In some embodiments, the dynamic current sink further includes a second resistor. The second resistor is coupled between the output node and the second terminal of the third transistor.

In some embodiments, the first transistor, the second transistor, and the third transistor are NMOS transistors (N-type Metal Oxide Semiconductor Field Effect Transistors).

In some embodiments, the LDO includes a second voltage comparator, a fourth transistor, a third resistor, and a fourth resistor. The second voltage comparator compares a second reference voltage with a feedback voltage, so as to generate the second control signal. The fourth transistor has a control terminal for receiving the second control signal, a first terminal coupled to a supply voltage, and a second terminal coupled to the output node. The third resistor is coupled between the output node and a sixth node. The sixth node has the feedback voltage. The fourth resistor is coupled between the sixth node and the ground voltage.

In some embodiments, the fourth transistor is configured to selectively supply a loading current to the output node.

In some embodiments, the output node is further coupled to a stabilizing capacitor and is arranged for driving an external loading element.

In some embodiments, if the loading current is changed, an overshoot output voltage or an undershoot output voltage occurs at the output node, and the first discharge current is arranged for stabilizing the output voltage at the output node.

In some embodiments, the first voltage comparator has a positive input terminal for receiving the first reference voltage, a negative input terminal for receiving the second control signal, and an output terminal for outputting the first control signal. The second voltage comparator has a positive input terminal for receiving the feedback voltage, a negative input terminal for receiving the second reference voltage, and an output terminal for outputting the second control signal. The fourth transistor is a PMOS transistor (P-type Metal Oxide Semiconductor Field Effect Transistor).

In some embodiments, the first voltage comparator has a positive input terminal for receiving the second control signal, a negative input terminal for receiving the first reference voltage, and an output terminal for outputting the first control signal. The second voltage comparator has a positive input terminal for receiving the second reference voltage, a negative input terminal for receiving the feedback voltage, and an output terminal for outputting the second control signal. The fourth transistor is an NMOS transistor (N-type Metal Oxide Semiconductor Field Effect Transistor).

In some embodiments, the dynamic current sink further includes a second inverter, a third current source, a fifth transistor, a second capacitor, a sixth transistor, a fifth resistor, and a seventh transistor. The second inverter has an input terminal coupled to the fourth node, and an output terminal coupled to a seventh node. The third current source supplies a third current to an eighth node. The fifth transistor has a control terminal coupled to the fourth node, a first terminal coupled to a ninth node, and a second terminal coupled to the eighth node. The second capacitor is coupled between the ninth node and the ground voltage. The sixth transistor has a control terminal coupled to the seventh node, a first terminal coupled to a tenth node, and a second terminal coupled to the ninth node. The fifth resistor is coupled between the tenth node and the ground voltage. The seventh transistor has a control terminal coupled to the ninth node, a first terminal coupled to the ground voltage, and a second terminal coupled to the output node. The seventh transistor is configured to selectively draw a second discharge current from the output node.

In some embodiments, the dynamic current sink further includes a sixth resistor. The sixth resistor is coupled between the output node and the second terminal of the seventh transistor.

In some embodiments, the fifth transistor, the sixth transistor, and the seventh transistor are NMOS transistors (N-type Metal Oxide Semiconductor Field Effect Transistors).

In some embodiments, the first discharge current and the second discharge current have different slopes over time axis.

In another preferred embodiment, the invention is directed to a dynamic current sink for stabilizing an output voltage at an output node of an LDO (Low Dropout Linear Regulator). The dynamic current sink includes a current comparator, a first transistor, a first current sink, a first capacitor, and a second transistor. The current comparator compares a partial loading current from the LDO with a reference current, so as to generate a first control signal. The first transistor has a control terminal for receiving the first control signal, a first terminal coupled to a supply voltage, and a second terminal coupled to a first node. The first current sink draws a first current from the first node. The first capacitor is coupled between the first node and a ground voltage. The second transistor has a control terminal coupled to the first node, a first terminal coupled to the ground voltage, and a second terminal coupled to the output node. The second transistor is configured to selectively draw a first discharge current from the output node.

In some embodiments, the dynamic current sink further includes a first resistor. The first resistor is coupled between the output node and the second terminal of the second transistor.

In some embodiments, the first transistor is a PMOS transistor (P-type Metal Oxide Semiconductor Field Effect Transistor), and the second transistor is an NMOS transistor (N-type Metal Oxide Semiconductor Field Effect Transistor).

In some embodiments, the LDO includes a voltage comparator, a third transistor, a second resistor, and a third resistor. The voltage comparator compares a reference voltage and a feedback voltage, so as to generate a second control signal. The third transistor has a control terminal for receiving the second control signal, a first terminal coupled to the supply voltage, and a second terminal coupled to the output node. The second resistor is coupled between the output node and a second node. The second node has the feedback voltage. The third resistor is coupled between the second node and the ground voltage.

In some embodiments, the third transistor is configured to selectively supply a loading current to the output node.

In some embodiments, the partial loading current is extracted from a portion of the loading current.

In some embodiments, the output node is further coupled to a stabilizing capacitor and is arranged for driving an external loading element.

In some embodiments, if the loading current is changed, an overshoot output voltage or an undershoot output voltage occurs at the output node, and the first discharge current is arranged for stabilizing the output voltage at the output node.

In some embodiments, the current comparator is coupled between the second terminal of the third transistor and the ground voltage. The voltage comparator has a positive input terminal for receiving the feedback voltage, a negative input terminal for receiving the reference voltage, and an output terminal for outputting the second control signal. The third transistor is a PMOS transistor (P-type Metal Oxide Semiconductor Field Effect Transistors).

In some embodiments, the current comparator is coupled between the supply voltage and the first terminal of the third transistor. The voltage comparator has a positive input terminal for receiving the reference voltage, a negative input terminal for receiving the feedback voltage, and an output terminal for outputting the second control signal. The third transistor is an NMOS transistor (N-type Metal Oxide Semiconductor Field Effect Transistors).

In some embodiments, the dynamic current sink further includes an inverter, a fourth transistor, a second current sink, a second capacitor, and a fifth transistor. The inverter has an input terminal coupled to the first node, and an output terminal coupled to a third node. The fourth transistor has a control terminal coupled to the third node, a first terminal coupled to the supply voltage, and a second terminal coupled to a fourth node. The second current sink draws a second current from the fourth node. The second capacitor is coupled between the fourth node and the ground voltage. The fifth transistor has a control terminal coupled to the fourth node, a first terminal coupled to the ground voltage, and a second terminal coupled to the output node. The fifth transistor is configured to selectively draw a second discharge current from the output node.

In some embodiments, the dynamic current sink further includes a fourth resistor. The fourth resistor is coupled between the output node and the second terminal of the fifth transistor.

In some embodiments, the fourth transistor is a PMOS transistor (P-type Metal Oxide Semiconductor Field Effect Transistor), and the fifth transistor is an NMOS transistor (N-type Metal Oxide Semiconductor Field Effect Transistor).

In some embodiments, the first discharge current and the second discharge current have different slopes over time axis.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are disclosed in detail as follows.

Figure 1A:
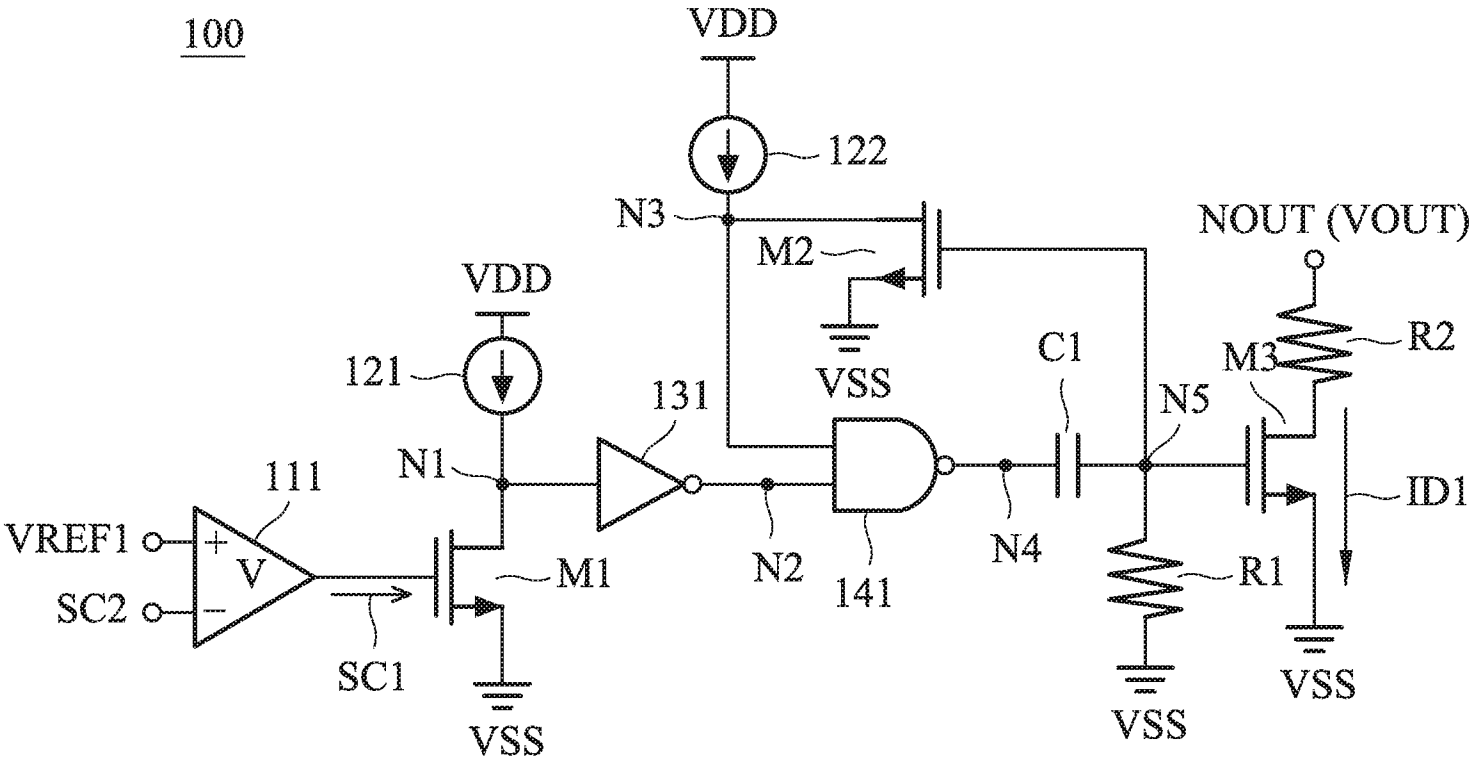
FIG. 1A is a diagram of a dynamic current sink according to an embodiment of the invention.
Figure 1B:
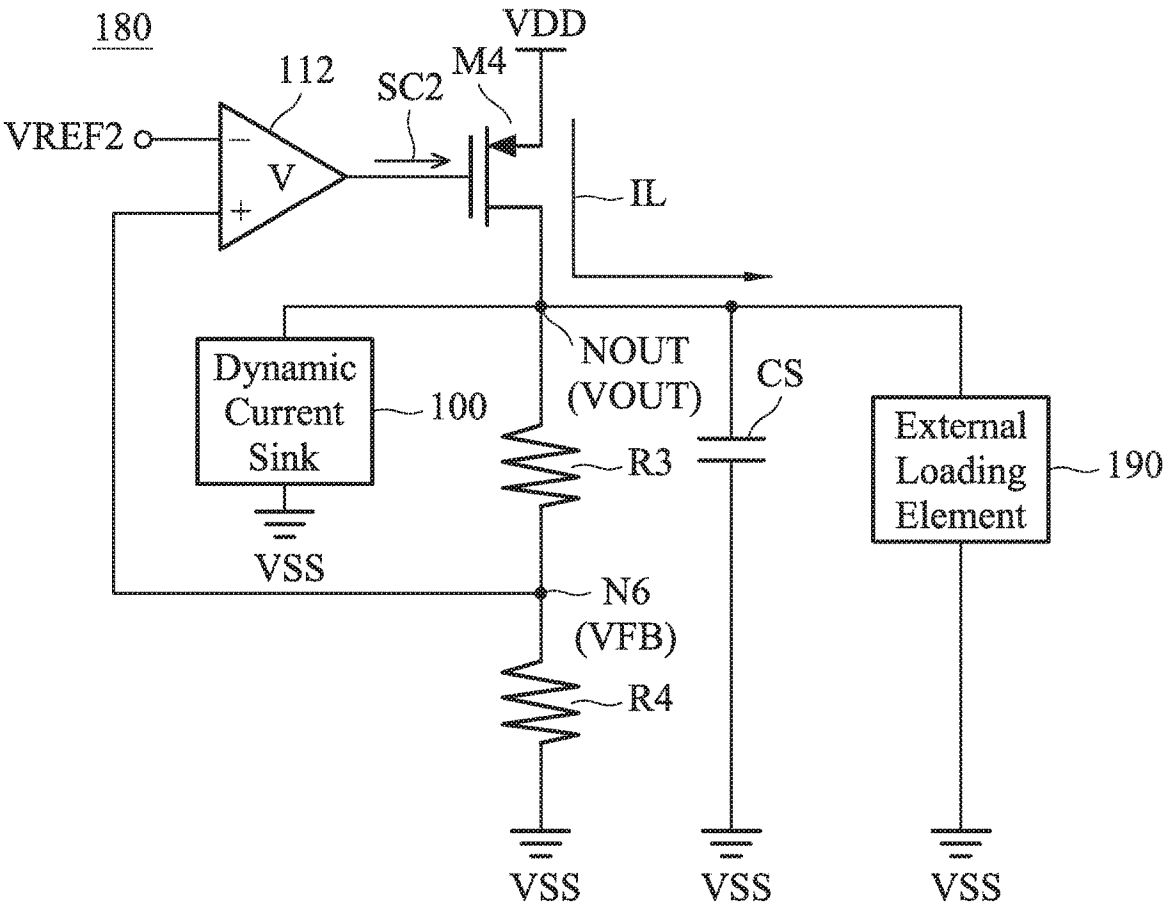
FIG. 1B is a diagram of an LDO (Low Dropout Linear Regulator) according to an embodiment of the invention.

FIG. 1A is a diagram of a dynamic current sink 100 according to an embodiment of the invention. FIG. 1B is a diagram of an LDO (Low Dropout Linear Regulator) 180 according to an embodiment of the invention. Please refer to FIG. 1A and FIG. 1B together. The dynamic current sink 100 is configured to stabilize an output voltage VOUT at an output node NOUT of the LDO 180. As shown in FIG. 1A, the dynamic current sink 100 includes a first voltage comparator 111, a first transistor M1, a first current source 121, a first inverter 131, a second current source 122, an NAND gate 141, a first capacitor C1, a first resistor R1, a second transistor M2, and a third transistor M3. The first transistor M1, the second transistor M2, and the third transistor M3 may be NMOS transistors (N-type Metal Oxide Semiconductor Field Effect Transistors). The first voltage comparator 111 compares a first reference voltage VREF1 with a second control signal SC2 from the LDO 180, so as to generate a first control signal SC1. Specifically, the first voltage comparator 111 has a positive input terminal for receiving the first reference voltage VREF1, a negative input terminal for receiving the second control signal SC2, and an output terminal for outputting the first control signal SC1. If the voltage at the positive input terminal is higher than the voltage at the negative input terminal, the first voltage comparator 111 will output a high logic level at the output terminal. The first transistor M1 has a control terminal for receiving the first control signal SC1, a first terminal coupled to a ground voltage VSS, and a second terminal coupled to a first node N1. The first current source 121 supplies a first current to the first node N1. The first inverter 131 has an input terminal coupled to the first node N1, and an output terminal coupled to a second node N2. The second current source 122 supplies a second current to a third node N3. The NAND gate 141 has a first input terminal coupled to the third node N3, a second input terminal coupled to the second node N2, and an output terminal coupled to a fourth node N4. The first capacitor C1 is coupled between the fourth node N4 and a fifth node N5. The first resistor R1 is coupled between the fifth node N5 and the ground voltage VSS. The second transistor M2 has a control terminal coupled to the fifth node N5, a first terminal coupled to the ground voltage VSS, and a second terminal coupled to the third node N3. The third transistor M3 has a control terminal coupled to the fifth node N5, a first terminal coupled to the ground voltage VSS, and a second terminal coupled to the output node NOUT of the LDO 180. The third transistor M3 is configured to selectively draw a first discharge current ID1 from the output node NOUT. In some embodiments, the dynamic current sink 100 further includes a second resistor R2 coupled between the output node NOUT and the second terminal of the third transistor M3, so as to limit the magnitude of the first discharge current ID1.

As shown in FIG. 1B, the LDO 180 includes a second voltage comparator 112, a fourth transistor M4, a third resistor R3, and a fourth resistor R4. The fourth transistor M4 is a PMOS transistor (P-type Metal Oxide Semiconductor Field Effect Transistor). The second voltage comparator 112 compares a second reference voltage VREF2 with a feedback voltage VFB, so as to generate the second control signal SC2. Specifically, the second voltage comparator 112 has a positive input terminal for receiving the feedback voltage VFB, a negative input terminal for receiving the second reference voltage VREF2, and an output terminal for outputting the second control signal SC2. If the voltage at the positive input terminal is higher than the voltage at the negative input terminal, the second voltage comparator 112 will output a high logic level at the output terminal. The fourth transistor M4 has a control terminal for receiving the second control signal SC2, a first terminal coupled to a supply voltage VDD, and a second terminal coupled to the output node NOUT. The third resistor R3 is coupled between the output node NOUT and a sixth node N6. The sixth node N6 has the feedback voltage VFB. The fourth resistor R4 is coupled between the sixth node N6 and the ground voltage VSS. The fourth transistor M4 is configured to selectively supply a loading current IL to the output node NOUT. The output node NOUT of the LDO 180 may be further coupled to a stabilizing capacitor CS and arranged for driving an external loading element 190. If the loading current IL is changed (e.g., the external loading element 190 is placed by another one which consumes different loading current), an overshoot output voltage or an undershoot output voltage may occur at the output node NOUT. The first discharge current D1 of the dynamic current sink 100 is arranged for stabilizing the output voltage VOUT at the output node NOUT of the LDO 180.

Figure 1C:
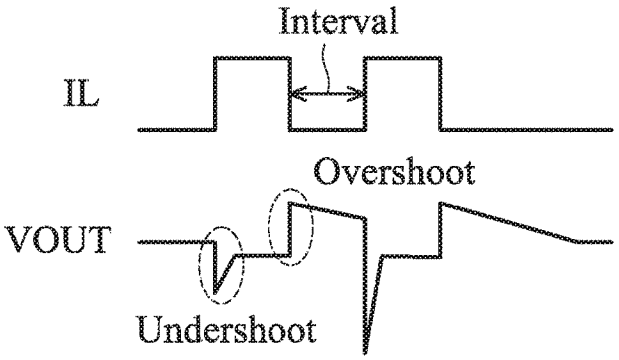
FIG. 1C is a diagram of signal waveforms of a conventional LDO without the proposed dynamic current sink.

FIG. 1C is a diagram of signal waveforms of a conventional LDO without the proposed dynamic current sink 100. As shown in FIG. 1C, the output node of a conventional LDO may have an overshoot/undershoot output voltage at each transition edge of the loading current. The transition edge of the loading current may result from a change of the external loading element 190. For example, if the external loading element 190 is replaced with another device which consumes more or less current, a transition edge of the loading current will be formed, and an overshoot/undershoot output voltage will occur at the output node of the LDO. For a conventional LDO, the overshoot/undershoot output voltage has a relatively large amplitude and a relatively long duration, and it leads to more output fluctuations, thereby negatively affecting the output stability of the LDO.

Figure 1D:
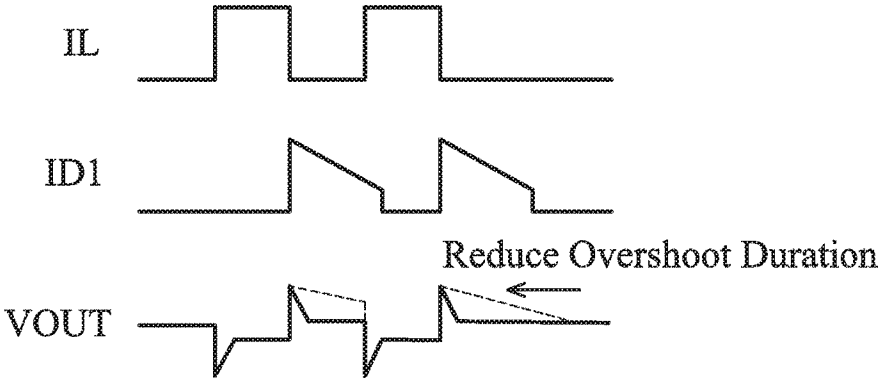
FIG. 1D is a diagram of signal waveforms of an LDO with the proposed dynamic current sink according to an embodiment of the invention.

FIG. 1D is a diagram of signal waveforms of the LDO 180 with the proposed dynamic current sink 100 according to an embodiment of the invention. The first discharge current ID1 of the dynamic current sink 100 can be arranged for pulling down the overshoot output voltage at the output node NOUT of the LDO 180. Please refer to FIGS. 1A-1D together to understand the operation theory. If the output voltage VOUT at the output node NOUT of the LDO 180 becomes too high (i.e., an overshoot output voltage occurs), the feedback voltage VFB may rise and trigger a low-to-high state transition of the second control signal SC2. The state transition of the second control signal SC2 results in the following chain reactions. The fourth transistor M4 is disabled, and it stops pulling up the output voltage VOUT. The first control signal SC1 has a high-to-low state transition. The first transistor M1 is disabled. The voltage at the first node N1 is pulled up to a high logic level by the first current source 121. The voltage at the second node N2 is pulled down to a low logic level by the first inverter 131. The voltage at the fourth node N4 and the voltage at the fifth node N5 are pulled up to a high logic level by the NAND gate 141. The second transistor M2 helps to stabilize the voltage at the fifth node N5. The third transistor M3 is enabled to draw the first discharge current ID1 from the output node NOUT, thereby pulling down the output voltage VOUT and eliminating the overshoot output voltage at the output node NOUT. Then, the first discharge current D1 gradually decreases to zero because of the voltage RC decay at the fifth node N5 (i.e., the transistor control terminal). In comparison to the waveforms of FIG. 1C, the duration and magnitude of the overshoot/undershoot output voltage of the LDO 180 of FIG. 1D are both significantly reduced by the dynamic current sink 100 (if the overshoot output voltage is reduced, the undershoot output voltage will also be reduced). Accordingly, the proposed dynamic current sink 100 can effectively stabilize the output voltage VOUT at the output node NOUT of the LDO 180.

Figure 2A:
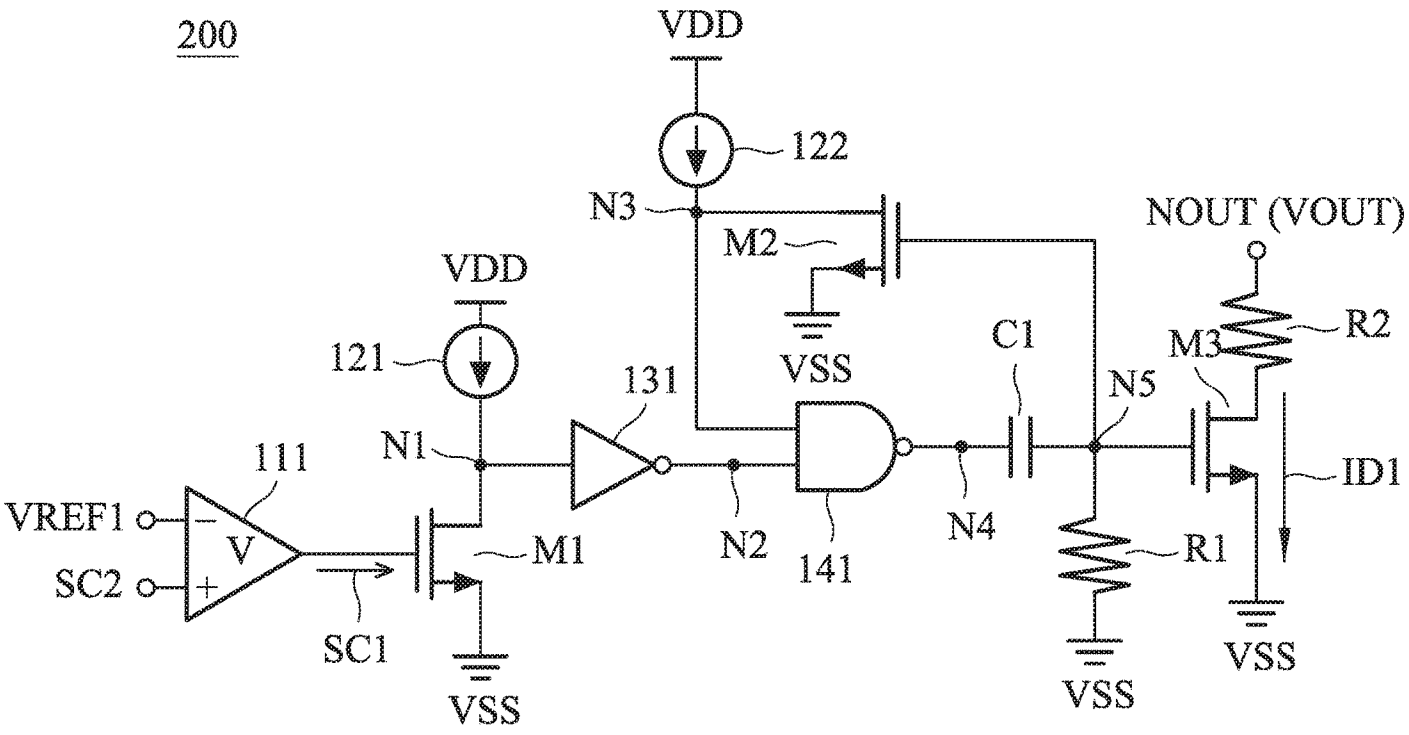
FIG. 2A is a diagram of a dynamic current sink according to an embodiment of the invention.
Figure 2B:
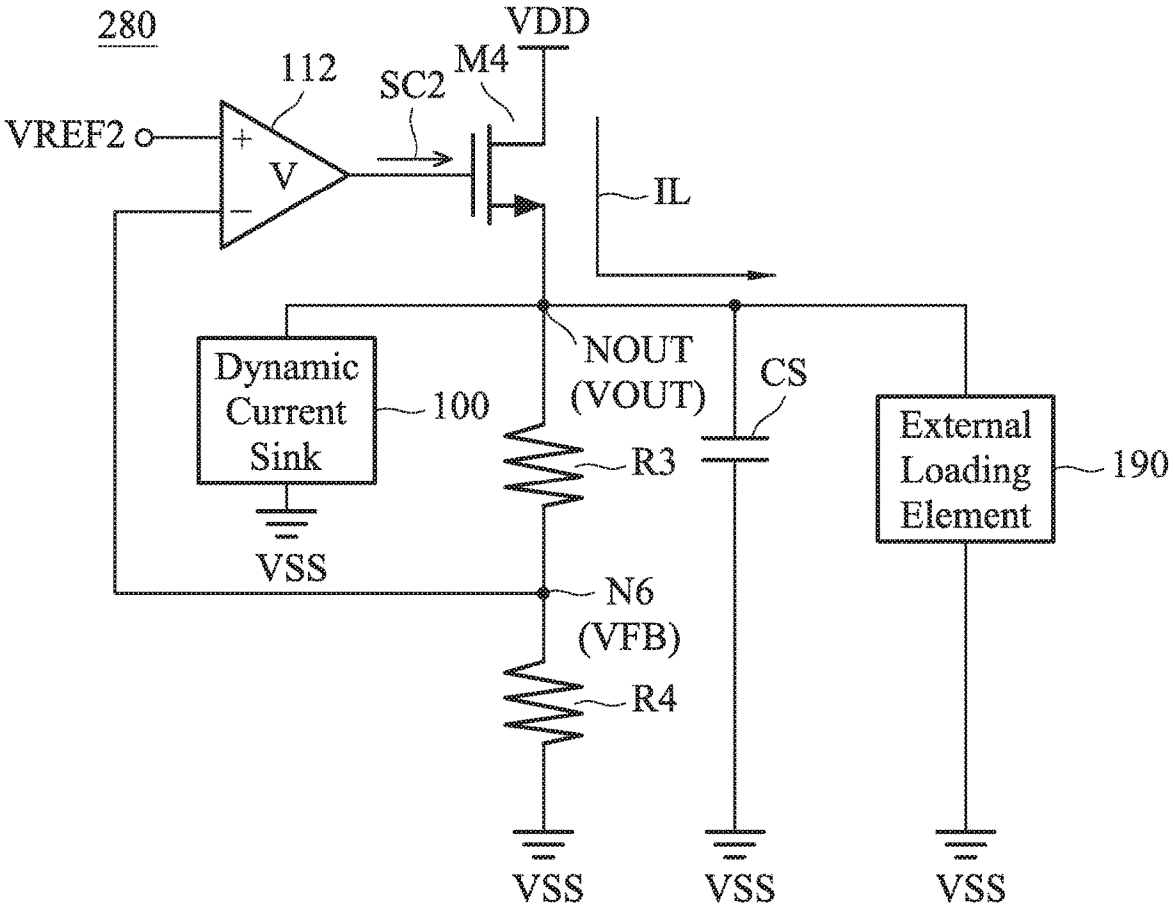
FIG. 2B is a diagram of an LDO according to an embodiment of the invention.

FIG. 2A is a diagram of a dynamic current sink 200 according to an embodiment of the invention. FIG. 2B is a diagram of an LDO 280 according to an embodiment of the invention. The dynamic current sink 200 is configured to stabilize an output voltage VOUT at an output node NOUT of the LDO 280. FIG. 2A and FIG. 2B are similar to FIG. 1A and FIG. 1B. In the embodiment of FIG. 2A and FIG. 2B, the first voltage comparator 111 has a positive input terminal for receiving the second control signal SC2, a negative input terminal for receiving the first reference voltage VREF1, and an output terminal for outputting the first control signal SC1. The second voltage comparator 112 has a positive input terminal for receiving the second reference voltage VREF2, a negative input terminal for receiving the feedback voltage VFB, and an output terminal for outputting the second control signal SC2. The fourth transistor M4 is an NMOS transistor. FIG. 2A and FIG. 2B show an alternative configuration of the invention, and they have similar theory of operation as mentioned in the embodiment of FIG. 1D. Other features of the dynamic current sink 200 and the LDO 280 of FIG. 2A and FIG. 2B are similar to those of the dynamic current sink 100 and the LDO 180 of FIG. 1A and FIG. 1B. Therefore, these embodiments can achieve similar levels of performance.

Figure 3A:
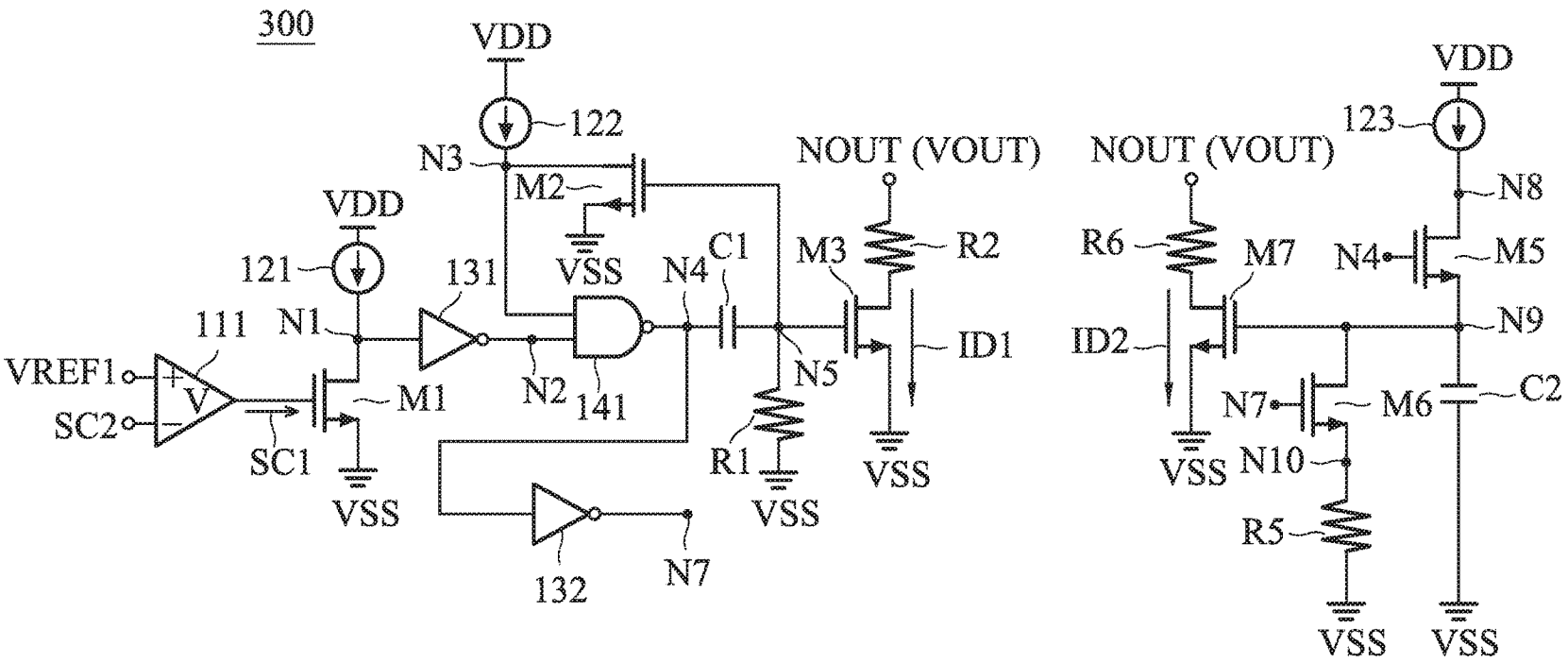
FIG. 3A is a diagram of a dynamic current sink according to an embodiment of the invention.

FIG. 3A is a diagram of a dynamic current sink 300 according to an embodiment of the invention. FIG. 3A is similar to FIG. 1A. In the embodiment of FIG. 3A, the first voltage comparator 111 has a positive input terminal for receiving the first reference voltage VREF1, a negative input terminal for receiving the second control signal SC2, and an output terminal for outputting the first control signal SC1. The dynamic current sink 300 is used for improving the LDO 180 of FIG. 1B. In comparison to FIG. 1A, the dynamic current sink 300 further includes a second inverter 132, a third current source 123, a fifth transistor M5, a second capacitor C2, a sixth transistor M6, a fifth resistor R5, and a seventh transistor M7. The fifth transistor M5, the sixth transistor M6, and the seventh transistor M7 may be NMOS transistors. The second inverter 132 has an input terminal coupled to the fourth node N4, and an output terminal coupled to a seventh node N7. The third current source 123 supplies a third current to an eighth node N8. The fifth transistor M5 has a control terminal coupled to the fourth node N4, a first terminal coupled to a ninth node N9, and a second terminal coupled to the eighth node N8. The second capacitor C2 is coupled between the ninth node N9 and the ground voltage VSS. The sixth transistor M6 has a control terminal coupled to the seventh node N7, a first terminal coupled to a tenth node N10, and a second terminal coupled to the ninth node N9. The fifth resistor R5 is coupled between the tenth node N10 and the ground voltage VSS. The seventh transistor M7 has a control terminal coupled to the ninth node N9, a first terminal coupled to the ground voltage VSS, and a second terminal coupled to the output node NOUT of the LDO 180. The seventh transistor M7 is configured to selectively draw a second discharge current ID2 from the output node NOUT. In some embodiments, the dynamic current sink 300 further includes a sixth resistor R6 coupled between the output node NOUT and the second terminal of the seventh transistor M7, so as to limit the magnitude of the second discharge current ID2.

Figure 3B:
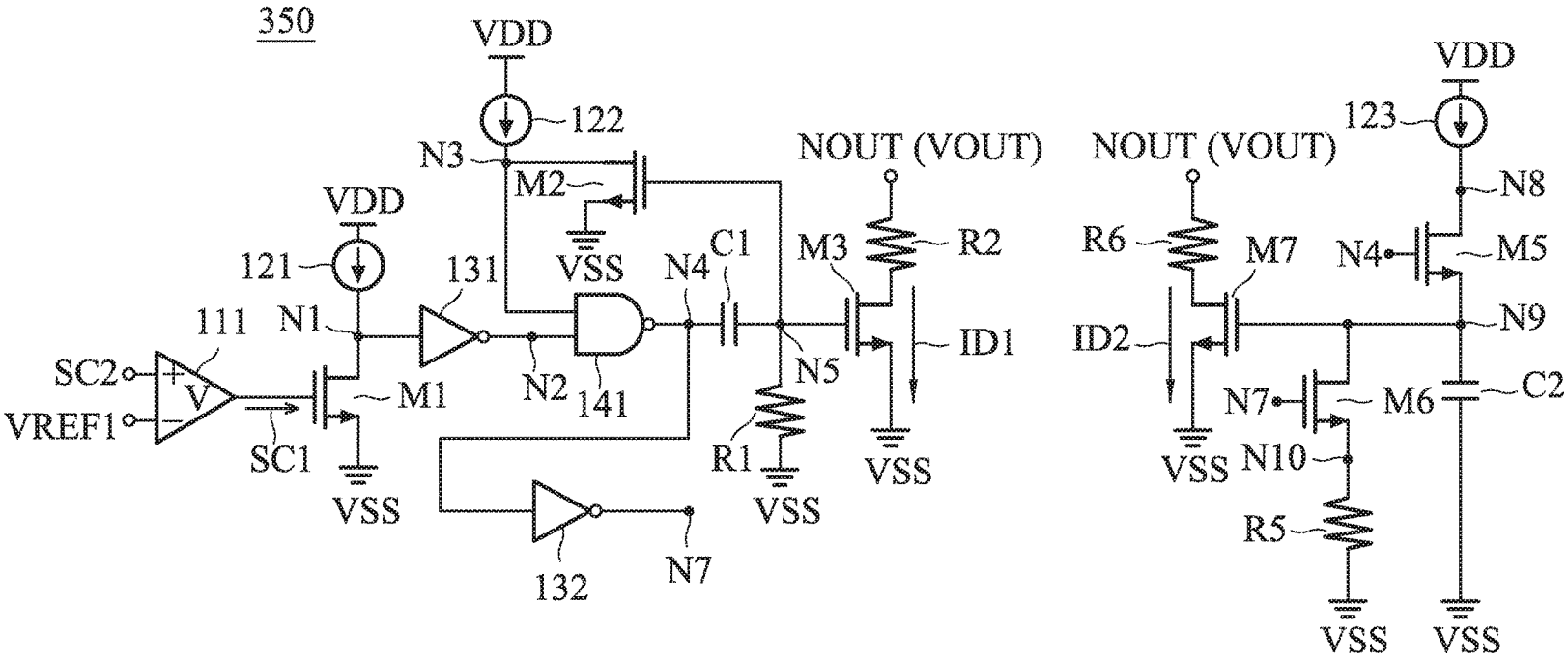
FIG. 3B is a diagram of a dynamic current sink according to an embodiment of the invention.

FIG. 3B is a diagram of a dynamic current sink 350 according to an embodiment of the invention. FIG. 3B is similar to FIG. 3A. In the embodiment of FIG. 3B, the first voltage comparator 111 has a positive input terminal for receiving the second control signal SC2, a negative input terminal for receiving the first reference voltage VREF1, and an output terminal for outputting the first control signal SC1. FIG. 3B shows an alternative configuration of the invention. The dynamic current sink 350 is used for improving the LDO 280 of FIG. 2B.

Figure 3C:
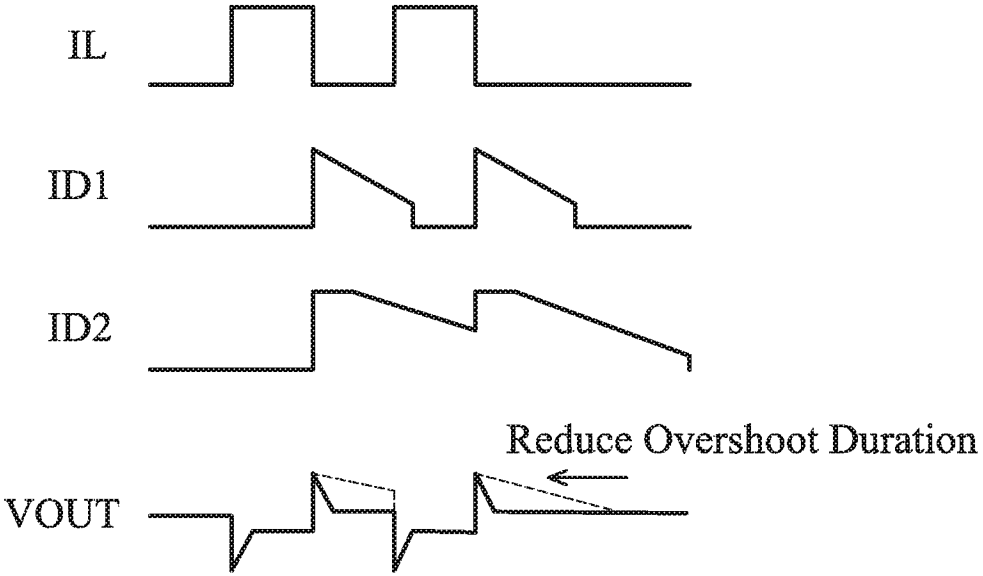
FIG. 3C is a diagram of signal waveforms of an LDO with the proposed dynamic current sink according to an embodiment of the invention.

FIG. 3C is a diagram of signal waveforms of the LDO 180 with the proposed dynamic current sink 300 according to an embodiment of the invention. The first discharge current ID1 and the second charging current ID2 of the dynamic current sink 300 can both be arranged for pulling down the overshoot output voltage at the output node NOUT of the LDO 180. The first discharge current ID1 and the second discharge current ID2 may have different slopes over time axis. For example, the resistance of the first resistor R1 may be different from that of the fifth resistor R5, and the capacitance of the first capacitor C1 may be different from that of the second capacitor C2, such that the waveform of the first discharge current ID1 is different from that of the second discharge current ID2 due to different RC constants at their transistor control terminals. The second discharge current ID2 is considered as an auxiliary current for eliminating the overshoot output voltage of the LDO 180. It should be understood that the signal waveforms of the LDO 280 with the proposed dynamic current sink 350 are the same as those of FIG. 3C, and they have similar operation theory.

Figure 4A:
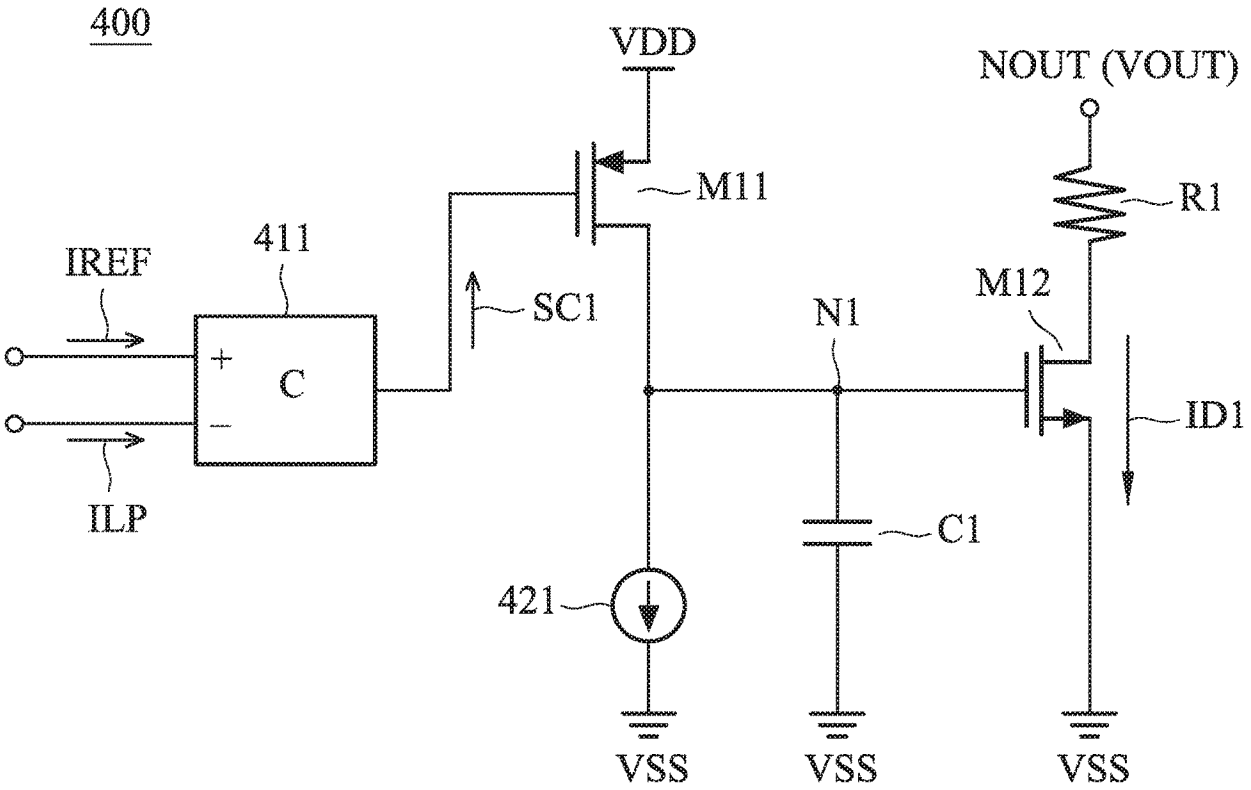
FIG. 4A is a diagram of a dynamic current sink according to an embodiment of the invention.
Figure 4B:
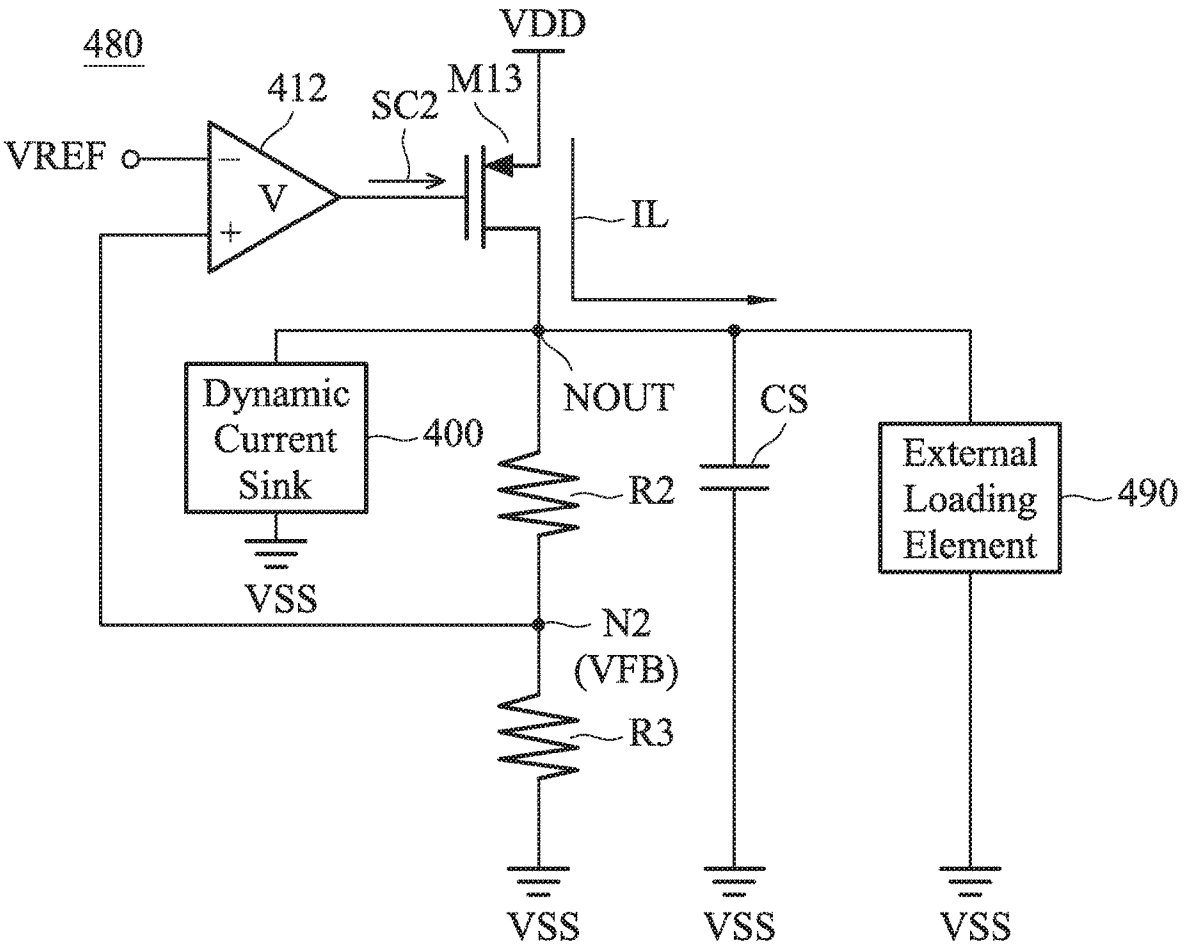
FIG. 4B is a diagram of an LDO according to an embodiment of the invention.

FIG. 4A is a diagram of a dynamic current sink 400 according to an embodiment of the invention. FIG. 4B is a diagram of an LDO (Low Dropout Linear Regulator) 480 according to an embodiment of the invention. Please refer to FIG. 4A and FIG. 4B together. The dynamic current sink 400 is configured to stabilize an output voltage VOUT at an output node NOUT of the LDO 480. As shown in FIG. 4A, the dynamic current sink 400 includes a current comparator 411, a first transistor M11, a first current sink 421, a first capacitor C1, and a second transistor M12. The first transistor M11 may be a PMOS transistor (P-type Metal Oxide Semiconductor Field Effect Transistor), and the second transistor M12 may be an NMOS transistor (N-type Metal Oxide Semiconductor Field Effect Transistor). The current comparator 411 compares a partial loading current ILP from the LDO 480 with a reference current IREF, so as to generate a first control signal SC1. Specifically, the current comparator 411 has a positive input terminal for receiving the reference current IREF, a negative input terminal for receiving the partial loading current ILP, and an output terminal for outputting the first control signal SC1. If the current to the positive input terminal is higher than the current to the negative input terminal, the current comparator 411 will output a high logic level at the output terminal. The first transistor M11 has a control terminal for receiving the first control signal SC1, a first terminal coupled to a supply voltage VDD, and a second terminal coupled to a first node N1. The first current sink 421 draws a first current from the first node N1. The first capacitor C1 is coupled between the first node N1 and a ground voltage VSS. The second transistor M12 has a control terminal coupled to the first node N1, a first terminal coupled to the ground voltage VSS, and a second terminal coupled to the output node NOUT of the LDO 480. The second transistor M12 is configured to selectively draw a first discharge current ID1 from the output node NOUT. In some embodiments, the dynamic current sink 400 further includes a first resistor R1 coupled between the output node NOUT and the second terminal of the second transistor M12, so as to limit the magnitude of the first discharge current D1.

As shown in FIG. 4B, the LDO 480 includes a voltage comparator 412, a third transistor M13, a second resistor R2, and a third resistor R3. The third transistor M13 may be a PMOS transistor. The voltage comparator 412 compares a reference voltage VREF and a feedback voltage VFB, so as to generate a second control signal SC2. Specifically, the voltage comparator 412 has a positive input terminal for receiving the feedback voltage VFB, a negative input terminal for receiving the reference voltage VREF, and an output terminal for outputting the second control signal SC2. If the voltage at the positive input terminal is higher than the voltage at the negative input terminal, the voltage comparator 412 will output a high logic level at the output terminal. The third transistor M13 has a control terminal for receiving the second control signal SC2, a first terminal coupled to the supply voltage VDD, and a second terminal coupled to the output node NOUT. The second resistor R2 is coupled between the output node NOUT and a second node N2. The second node N2 has the feedback voltage VFB. The third resistor R3 is coupled between the second node N2 and the ground voltage VSS. The third transistor M13 is configured to selectively supply a loading current IL to the output node NOUT. In the embodiment of FIG. 4A and FIG. 4B, the current comparator 411 is coupled between the second terminal (drain) of the third transistor M13 of the LDO 480 and the ground voltage VS S, so as to extract the partial loading current ILP from the LDO 480. The partial loading current ILP is extracted from a portion of the loading current IL. For example, the partial loading current ILP may be 1% or 2% of the loading current IL. The output node NOUT of the LDO 480 may be further coupled to a stabilizing capacitor CS and arranged for driving an external loading element 490. If the loading current IL is changed (e.g., the external loading element 490 is placed by another one which consumes different loading current), an overshoot output voltage or an undershoot output voltage may occur at the output node NOUT. The first discharge current D1 of the dynamic current sink 400 is arranged for stabilizing the output voltage VOUT at the output node NOUT of the LDO 480.

Figure 4C:
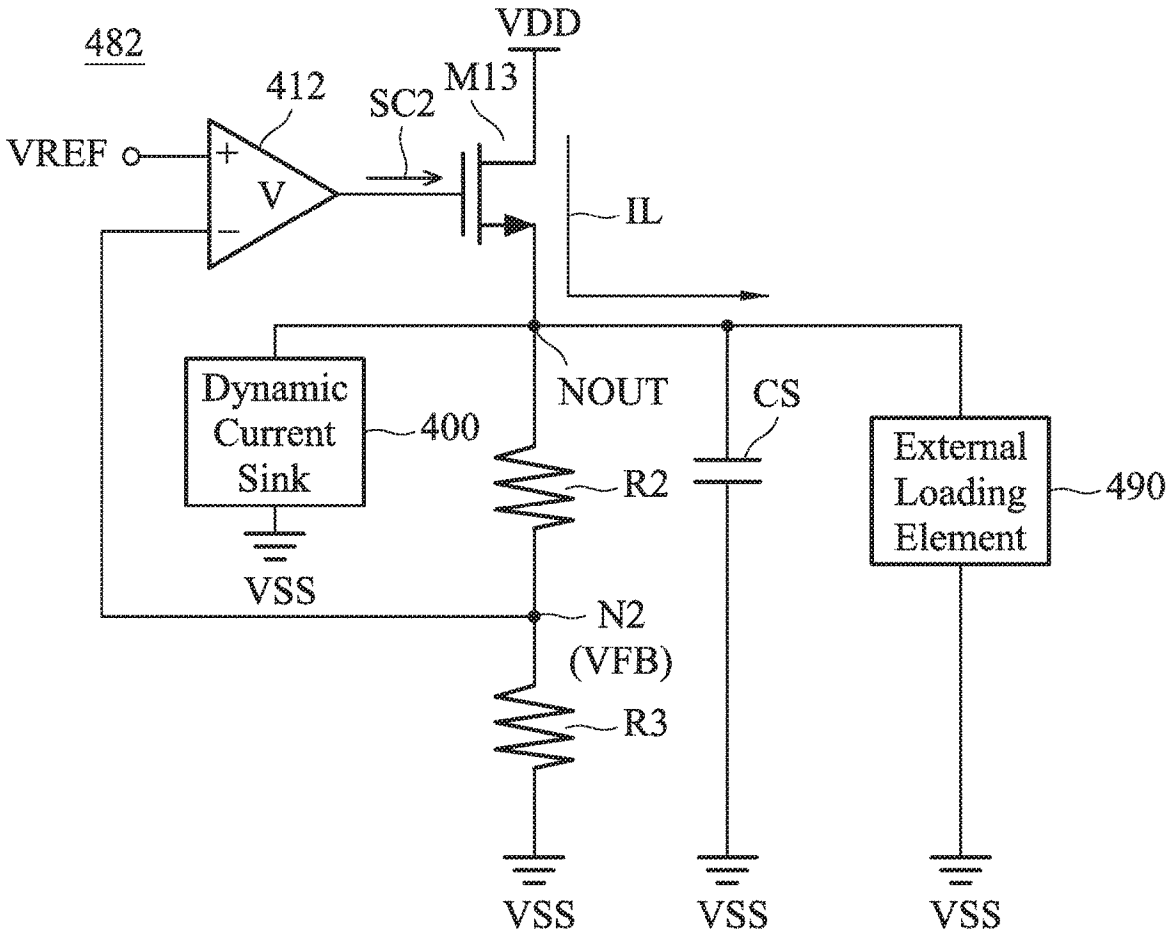
FIG. 4C is a diagram of an LDO according to an embodiment of the invention.

FIG. 4C is a diagram of an LDO 482 according to an embodiment of the invention. FIG. 4C is similar to FIG. 4B. In the embodiment of FIG. 4C, the voltage comparator 412 has a positive input terminal for receiving the reference voltage VREF, a negative input terminal for receiving the feedback voltage VFB, and an output terminal for outputting the second control signal SC2. The third transistor M13 is an NMOS transistor. FIG. 4C shows an alternative configuration of the invention. In alternative embodiments, the dynamic current sink 400 of FIG. 4A is configured to stabilize an output voltage VOUT at an output node NOUT of the LDO 482. In the embodiment of FIG. 4A and FIG. 4C, the current comparator 411 is coupled between the supply voltage VDD and the first terminal (drain) of the third transistor M13 of the LDO 482, so as to extract the partial loading current ILP from the LDO 482.

Figure 5A:
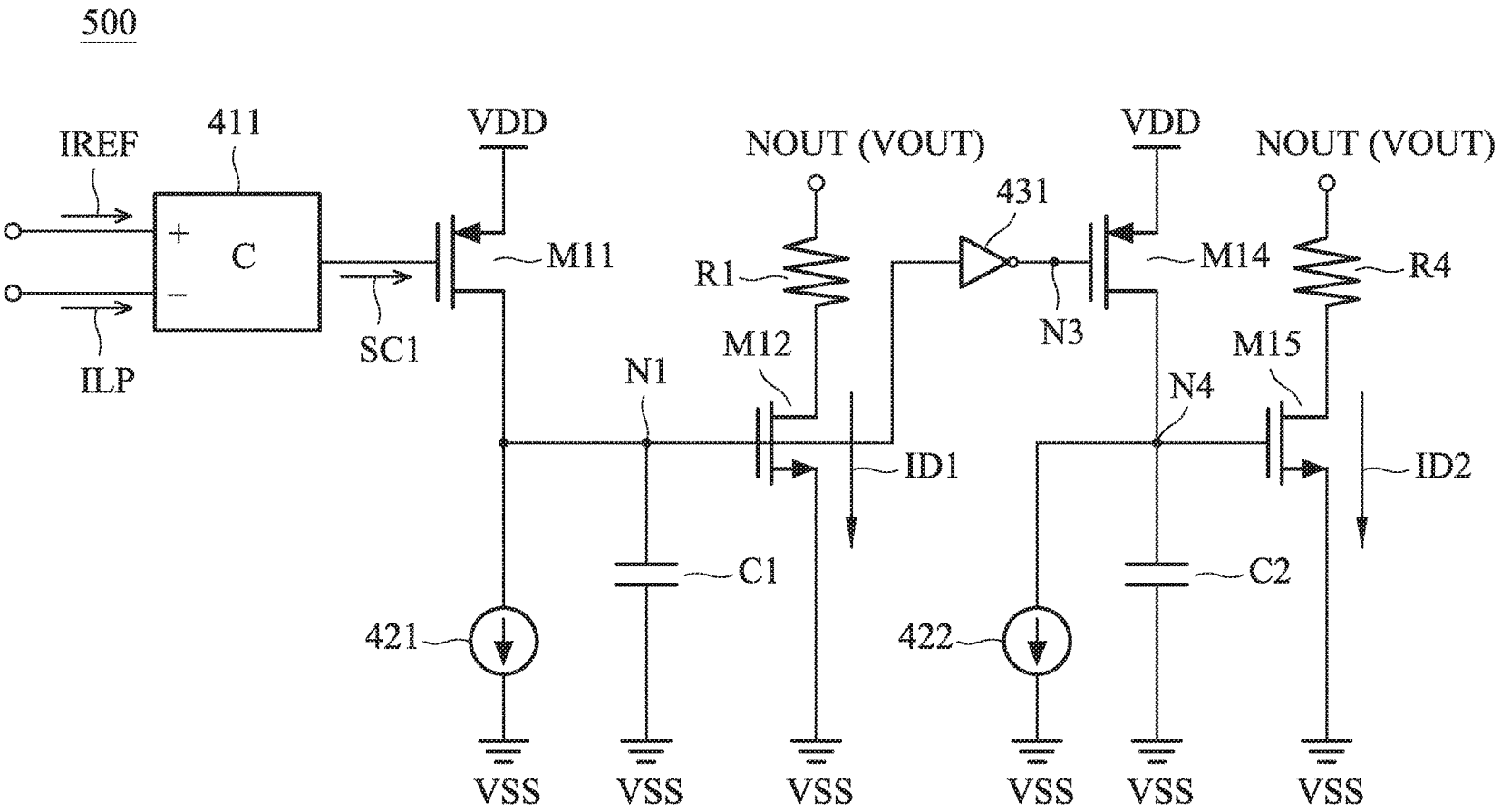
FIG. 5A is a diagram of a dynamic current sink according to an embodiment of the invention.

FIG. 5A is a diagram of a dynamic current sink 500 according to an embodiment of the invention. FIG. 5A is similar to FIG. 4A. The dynamic current sink 500 is configured to stabilize the output voltage VOUT at the output node NOUT of the LDO 480 (or 482). When the dynamic current sink 500 is used for the LDO 480, the current comparator 411 is coupled between the second terminal (drain) of the third transistor M13 of the LDO 480 and the ground voltage VSS, so as to extract the partial loading current ILP from the LDO 480. When the dynamic current sink 500 is used for the LDO 482, the current comparator 411 is coupled between the supply voltage VDD and the first terminal (drain) of the third transistor M13 of the LDO 482, so as to extract the partial loading current ILP from the LDO 482. In the embodiment of FIG. 5A, the dynamic current sink 500 further includes an inverter 431, a fourth transistor M14, a second current sink 422, a second capacitor C2, and a fifth transistor M15. The fourth transistor M14 may be a PMOS transistor, and the fifth transistor M15 may be an NMOS transistor. The inverter 431 has an input terminal coupled to the first node N1, and an output terminal coupled to a third node N3. The fourth transistor M14 has a control terminal coupled to the third node N3, a first terminal coupled to the supply voltage VDD, and a second terminal coupled to a fourth node N4. The second current sink 422 draws a second current from the fourth node N4. The second capacitor C2 is coupled between the fourth node N4 and the ground voltage VSS. The fifth transistor M15 has a control terminal coupled to the fourth node N4, a first terminal coupled to the ground voltage VSS, and a second terminal coupled to the output node NOUT of the LDO 480 (or 482). The fifth transistor M15 is configured to selectively draw a second discharge current ID2 from the output node NOUT. In some embodiments, the dynamic current sink 500 further includes a fourth resistor R4 coupled between the output node NOUT and the second terminal of the fifth transistor M15, so as to limit the magnitude of the second discharge current ID2.

Figure 5B:
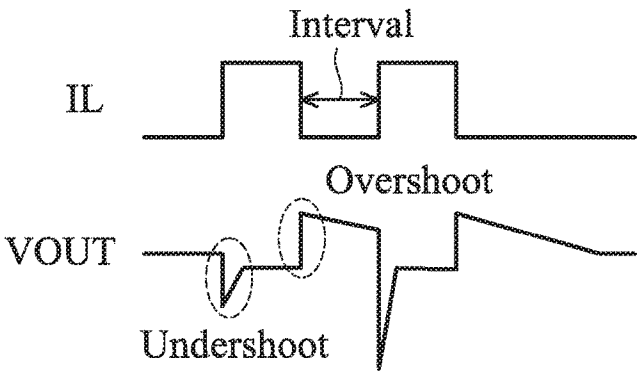
FIG. 5B is a diagram of signal waveforms of a conventional LDO without the proposed dynamic current sink.

FIG. 5B is a diagram of signal waveforms of a conventional LDO without the proposed dynamic current sink 500. As shown in FIG. 5B, the output node of a conventional LDO may have an overshoot/undershoot output voltage at each transition edge of the loading current. The transition edge of the loading current may result from a change of the external loading element 490. For example, if the external loading element 490 is replaced with another device which consumes more or less current, a transition edge of the loading current will be formed, and an overshoot/undershoot output voltage will occur at the output node of the LDO. For a conventional LDO, the overshoot/undershoot output voltage has a relatively large amplitude and a relatively long duration, and it leads to more output fluctuations, thereby negatively affecting the output stability of the LDO.

Figure 5C:
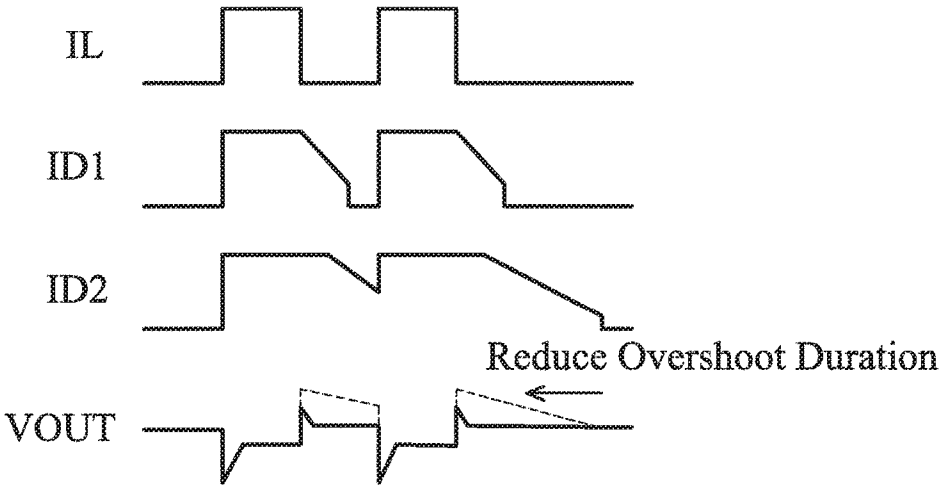
FIG. 5C is a diagram of signal waveforms of an LDO with the proposed dynamic current sink according to an embodiment of the invention.

FIG. 5C is a diagram of signal waveforms of the LDO 480 with the proposed dynamic current sink 500 according to an embodiment of the invention. The first discharge current ID1 and the second discharge current ID2 of the dynamic current sink 500 can be arranged for pulling down the overshoot output voltage at the output node NOUT of the LDO 480. Please refer to FIGS. 4A, 4B and 5A-5C together to understand the operational theory. Before an overshoot output voltage occurs at the output node NOUT of the LDO 480, the dynamic current sink 500 keeps drawing the first discharge current ID1 and the second discharge current ID2 from the output node NOUT. If the output voltage VOUT at the output node NOUT becomes too high (i.e., an overshoot output voltage occurs), the feedback voltage VFB may rise and trigger a low-to-high state transition of the second control signal SC2. The third transistor M13 is disabled, and it stops pulling up the output voltage VOUT. The state transition of the second control signal SC2 results in the following chain reactions. The partial loading current IPL becomes smaller than the reference current IREF. The first control signal SC1 has a low-to-high state transition. The first transistor M11 is disabled. The voltage at the first node N1 is gradually pulled down to a low logic level by the first current sink 421. The second transistor M12 is gradually turned off. The first discharge current ID1 gradually decreases to zero. Then, the voltage at the third node N3 is pulled up to a high logic level by the inverter 431. The fourth transistor M14 is disabled. The voltage at the fourth node N4 is gradually pulled down to a low logic level by the second current sink 422. The fifth transistor M15 is gradually turned off. The second discharge current ID2 gradually decreases to zero. FIG. 5A shows an alternative configuration of the invention. The overshoot output voltage of the LDO 480 is eliminated previously by the first discharge current D1 and the second discharge current ID2 of the dynamic current sink 500. When the overshoot output voltage actually occurs, the dynamic current sink 500 gradually stops drawing the first discharge current D1 and the second discharge current ID2 from the output node NOUT of the LDO 480. In comparison to the signal waveforms of FIG. 5B, the duration and magnitude of the overshoot/undershoot output voltage of the LDO 480 of FIG. 5C are both significantly reduced by the dynamic current sink 500 (if the overshoot output voltage is reduced, the undershoot output voltage will also be reduced). Accordingly, the proposed dynamic current sink 500 can effectively stabilize the output voltage VOUT at the output node NOUT of the LDO 480. It should be understood that the signal waveforms of the LDO 482 with the proposed dynamic current sink 500 are the same as that of FIG. 5C, and they have a similar theory of operation. The first discharge current ID1 and the second discharge current ID2 may have different slopes over time axis. For example, the capacitance of the first capacitor C1 may be different from that of the second capacitor C2, such that the waveform of the first discharge current ID1 is different from that of the second discharge current ID2 due to different RC constants at their transistor control terminals. The second discharge current ID2 is considered as an auxiliary current for eliminating the overshoot output voltage of the LDO 480 (or 482). In alternative embodiments, only one of the first discharge current ID1 and the second discharge current ID2 is used, and the invention can still work in a similar way.

The invention proposes a novel dynamic current sink to stabilize an output voltage at an output node of an LDO. By forming a negative feedback detection mechanism and drawing at least one discharge current from the output node of the LDO, the overshoot/undershoot output voltage at the output node of the LDO can be suppressed effectively. The output voltage of the LDO approaches a constant value. The invention can enhance the output stability of the LDO, and it is suitable for application in a variety of integrated circuit designs.

The above voltages, currents, and other parameters are just exemplary, rather than limitations of the invention. One of ordinary skill may adjust these settings according to different requirements. It should be understood that the proposed dynamic current sink and LDO are not limited to the configurations of FIGS. 1A-5C. The invention may merely include any one or more features of any one or more embodiments of FIGS. 1A-5C. In other words, not all of the features shown in the figures should be implemented in the proposed dynamic current sink and LDO of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A dynamic current sink for stabilizing an output voltage at an output node of an LDO (Low Dropout Linear Regulator), comprising:

a first voltage comparator, comparing a first reference voltage with a second control signal from the LDO, so as to generate a first control signal;

a first transistor, wherein the first transistor has a control terminal for receiving the first control signal, a first terminal coupled to a ground voltage, and a second terminal coupled to a first node;

a first current source, supplying a first current to the first node;

a first inverter, wherein the first inverter has an input terminal coupled to the first node, and an output terminal coupled to a second node;

a second current source, supplying a second current to a third node;

an NAND gate, wherein the NAND gate has a first input terminal coupled to the third node, a second input terminal coupled to the second node, and an output terminal coupled to a fourth node;

a first capacitor, coupled between the fourth node and a fifth node;

a first resistor, coupled between the fifth node and the ground voltage;

a second transistor, wherein the second transistor has a control terminal coupled to the fifth node, a first terminal coupled to the ground voltage, and a second terminal coupled to the third node; and a third transistor, wherein the third transistor has a control terminal coupled to the fifth node, a first terminal coupled to the ground voltage, and a second terminal coupled to the output node;

wherein the third transistor is configured to selectively draw a first discharge current from the output node.

2. The dynamic current sink as claimed in claim 1, further comprising:

a second resistor, coupled between the output node and the second terminal of the third transistor.

3. The dynamic current sink as claimed in claim 1, wherein the LDO comprises:

a second voltage comparator, comparing a second reference voltage with a feedback voltage, so as to generate the second control signal;

a fourth transistor, wherein the fourth transistor has a control terminal for receiving the second control signal, a first terminal coupled to a supply voltage, and a second terminal coupled to the output node;

a third resistor, coupled between the output node and a sixth node, wherein the sixth node has the feedback voltage; and a fourth resistor, coupled between the sixth node and the ground voltage.

4. The dynamic current sink as claimed in claim 3, wherein the fourth transistor is configured to selectively supply a loading current to the output node.

5. The dynamic current sink as claimed in claim 4, wherein if the loading current is changed, an overshoot output voltage or an undershoot output voltage occurs at the output node, and the first discharge current is arranged for stabilizing the output voltage at the output node.

6. The dynamic current sink as claimed in claim 3, wherein the output node is further coupled to a stabilizing capacitor and is arranged for driving an external loading element.

7. The dynamic current sink as claimed in claim 3, wherein the first voltage comparator has a positive input terminal for receiving the first reference voltage, a negative input terminal for receiving the second control signal, and an output terminal for outputting the first control signal, wherein the second voltage comparator has a positive input terminal for receiving the feedback voltage, a negative input terminal for receiving the second reference voltage, and an output terminal for outputting the second control signal, and wherein the fourth transistor is a PMOS transistor (P-type Metal Oxide Semiconductor Field Effect Transistor).

8. The dynamic current sink as claimed in claim 1, further comprising:

a second inverter, wherein the second inverter has an input terminal coupled to the fourth node, and an output terminal coupled to a seventh node;

a third current source, supplying a third current to an eighth node;

a fifth transistor, wherein the fifth transistor has a control terminal coupled to the fourth node, a first terminal coupled to a ninth node, and a second terminal coupled to the eighth node;

a second capacitor, coupled between the ninth node and the ground voltage;

a sixth transistor, wherein the sixth transistor has a control terminal coupled to the seventh node, a first terminal coupled to a tenth node, and a second terminal coupled to the ninth node;

a fifth resistor, coupled between the tenth node and the ground voltage; and a seventh transistor, wherein the seventh transistor has a control terminal coupled to the ninth node, a first terminal coupled to the ground voltage, and a second terminal coupled to the output node;

wherein the seventh transistor is configured to selectively draw a second discharge current from the output node.

9. The dynamic current sink as claimed in claim 8, further comprising:

a sixth resistor, coupled between the output node and the second terminal of the seventh transistor.

10. The dynamic current sink as claimed in claim 8, wherein the first discharge current and the second discharge current have different slopes over time axis.

* * * * *